US005299404A

United States Patent [19]

Jabro

[11] Patent Number: 5,299,404

[45] Date of Patent: Apr. 5, 1994

[54] PATCHING KIT FOR HOLLOW DOORS AND WALLS

[76] Inventor: Bahjat S. Jabro, 2112 Greenwick Rd., El Cajon, Calif. 92020

[21] Appl. No.: 51,515

[22] Filed: Apr. 26, 1993

[51] Int. Cl.[5] ..... E04G 23/02

[52] U.S. Cl. ..... 52/514

[58] Field of Search ..... 52/514; 156/94; 264/36

[56] References Cited

U.S. PATENT DOCUMENTS

| | | | |
|---|---|---|---|
| 2,598,194 | 5/1952 | Shippey | 52/514 |
| 2,997,416 | 8/1961 | Helton | 52/514 |
| 3,583,122 | 6/1971 | Biegajski . | |
| 3,999,347 | 12/1976 | Devlin . | |
| 4,193,243 | 3/1980 | Tiner . | |
| 4,285,183 | 8/1981 | Condit . | |
| 4,335,554 | 6/1982 | Nicholson | 52/514 |
| 5,018,331 | 5/1991 | Forzano | 52/514 X |
| 5,117,605 | 6/1992 | Waldbeiser | 52/514 |

*Primary Examiner*—Carl D. Friedman
*Assistant Examiner*—Kevin D. Wilkens
*Attorney, Agent, or Firm*—George J. Rubens

[57] ABSTRACT

A patching kit is provided for repairing holes of various kinds in the hollow walls of building components, such as doors and wallboard walls where the backside of the front walls are not readily accessible. The kit includes a backing plate of a stiff material of a size that can be inserted through the hole and sufficiently large to be positioned flat against the back surface of the front wall and cover substantially the entire area of the hole, forming a front recessed pocket to receive a suitable filler material. The peripheral area of the backing plate is coated with a suitable adhesive. The backing plate is firmly secured in position until the adhesive sets by a simple wedge means.

6 Claims, 1 Drawing Sheet

PATCHING KIT FOR HOLLOW DOORS AND WALLS

BACKGROUND OF THE INVENTION

This invention relates to a novel kit for repairing relatively large holes in building doors and walls, and more particularly in such hollow structures where the inside of the hollow structure is not easily accessible to secure a backing plate to close the hole for receiving a filler material.

In such hollow structures, it is frequently desirable to repair holes, which have been accidentally or otherwise caused, instead of hanging a new door. In order to repair such a door or wall by the application of a suitable filler material into the hole, it is necessary to provide a firm backing plate on the back side of the front wall to support the application of a suitable paste material. The use of paper or other means to provide such a backing is unsatisfactory because it does not provide a firm backing, and if the material is absorbent, it will absorb the moisture in the filler material and cause cracks.

Numerous devices have been patented to facilitate such repairs, but most are relatively complex not readily usable by inexperienced persons, such as the average homeowner.

U.S. Pat. No. 3,583,122 to Bieyajski on Jun. 8, 1971 discloses a repair kit for closing a hole in a wallboard type of wall that uses a foldable panel which can be inserted through the hole and unfolded on the back side of the wall and secured in position by a string attached to the wall.

U.S. Pat. No. 3,999,347 to Devlin on Dec. 28, 1976 discloses a similar type of device wherein the backing plate is secured in position inside the wall by a spring bow member U.S. Pat. No. 4,193,243 to Tiner on Mar. 18, 1980 discloses a kit for repairing door holes which utilizes a perforated backing plate secured in position by a tool having resilient legs inserted through the perforated backing plate and engaging the back wall of the door and maintained in position by the fingers of the user.

U.S. Pat. No. 4,285,185 to Condit on Aug. 25, 1981 discloses a foldable backing plate secured in position by a wire bridge that must be positioned exactly perpendicular to the wall.

None of the above described patents show means for using a positive means to secure the backing plate firmly in position.

OBJECTS OF THE INVENTION

A principle object of this invention is to provide a device, preferrably in the form of a kit, that will enable the quick repair of relatively large holes in the hollow doors and wallboard type of walls usually in residential buildings, avoiding the cost of replacing the door or an entire section of the wallboard.

Other important objects are to provide such a repair kit that is simple to use by the average homeowner avoiding the cost of a professional artisan which kit inexpensive to manufacture: which will avoid replacing the damaged door; and which will produce a superior repair.

SUMMARY OF THE INVENTION

A patching kit is provided for repairing relatively large holes in hollow doors and walls of buildings. The kit utilizes a backing plate that is positioned inside the door or wall against the back side of the front wall panel to cover the hole. Thus, the backing plate forms a recessed area in which is applied a suitable plastic filler material to restore the door or wall to its original appearance The patching kit may include one or more backing plates of different sizes, preferably made of a thin, but rigid, sheet material capable of being inserted through the hole and adhesibly secured to the backside of the front panel of the door or wall to cover the the hole and form a recessed area. The backing plate is provided with a detachable pin which extends through the hole to receive a wedge bar for applying pressure to maintain the adhesively coated backing plate in position until the adhesive sets. Thereafter the pin and wedge bar are removed to enable the recessed area to be filled with the suitable plastic material to complete the patching job.

IN THE DRAWINGS

DETAILED DESCRIPTION OF THE INVENTION

Figure 1:
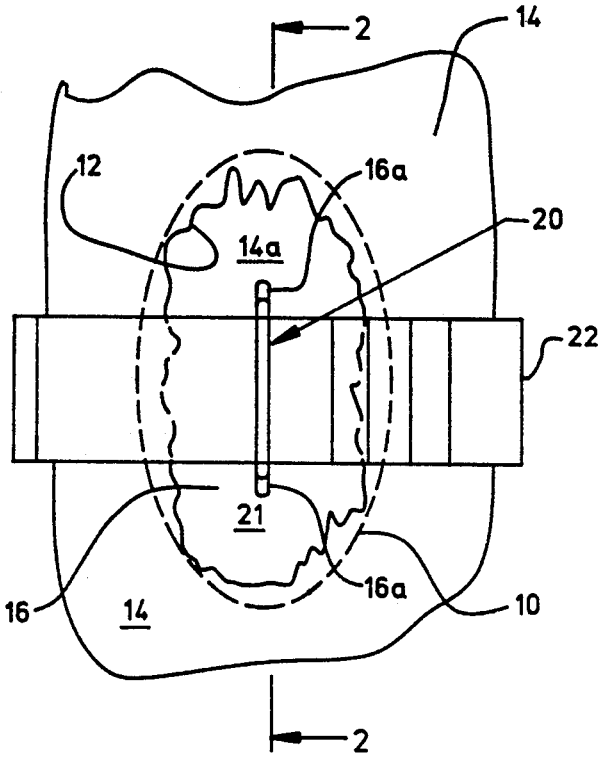
FIG. 1 is a front elevation view of a portion of a conventional hollow door or wall structure having a hole in the front panel thereof, showing the novel patching kit supported of the front side of the panel for securing a backing plate on the inside of the structure forming a recessed area to receive a suitable filler matrial.

Referring to the drawing where like reference numerals refer to similar parts throughout the figures, there is shown in FIG. 1 a novel patching kit 10 assembled to repair a hole 12, caused accidently, or otherwise, in a hollow building structure, such as a door or a wall fabricated of wallboard 14. In such a building structure the inner side of front panel containing in the hole is not easily accessible inorder to provide a backing to block the hole so that a filler material can be applied to complete the patch.

Patching kit 10 includes a backing plate 16 which may be included in the kit in several different sizes to accommodate holes of different areas. Backing plate 16 is preferably made of thin, light weight sheet sheet material that can be easily cut to fit the configuration of the hole, and somewhat stiff for reasons to be described. Backing plate 16 must be of a width and length so it can be inserted through hole 12 from the front side of the panel and snugly positioned against the back side of the front panel to be patched and cover substantially the entire area of the hole to provide a recessed area to receive the patch compound.

Prior to inserting backing plate 16 through hole 12, the backing plate is coated around its periphery with a suitable adhesive 18 arranged to contact the backside of the panel 14 around the periphery of the hole to maintain the backing plate in position until the adhesive sets by a means hereafter described.

The novel patching kit also includes a u-shaped pin 20 adapted to be detachably anchored to the front face of backing plate 16, which pin 20 has a dual function. Pin 20 provides a convenient means for the person making the repairs to position the backing through the hole and pressed flush against the backside of the panel with the adhesive in contact therewith. In this position, backing plate should block substantially the entire area of hole 12 to form a recessed pocket 14*a* to receive a suitable patching paste (not shown) to be smoothed in, such as a wood product for wooden doors, or a wallboard mix.

Figure 3:
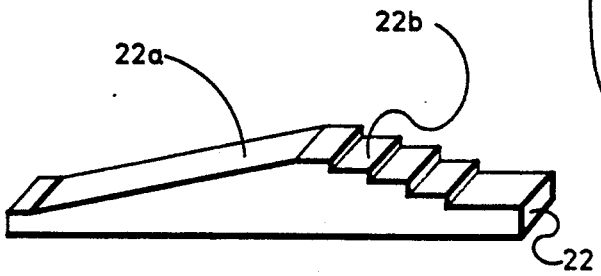
FIG. 3 is a perspective view of the wedge component of the patching kit showing a sloping and a stepped surface.

Pin 20 also functions to provide a means for receiving a wedge member 22 for maintaining backing plate 16 in its installed position against the backside of front panel until the adhesive sets. Wedge member 22 is of a length to bridge the smallest dimension of hole 12 so that when the wedge member is inserted through the loop of pin 20 to an appropriate location, backing plate is firmly engaging the backside of the front panel. Wedge member 22 can be made of any inexpensive material, such as wood or plastic, and may be constructed with a smooth sloping surface 22*a* or/and a stepped surface 22*b*, as illustrated in FIG. 3.

Figure 2:
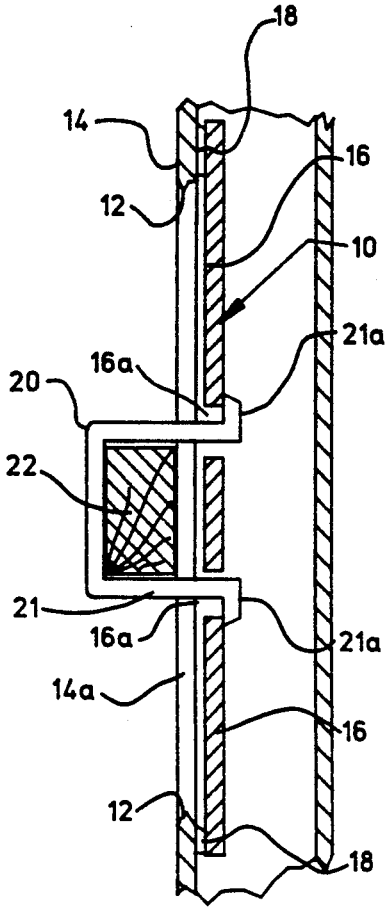
FIG. 2 is a vertical cross section of the structure of FIG. 1, slightly enlarged, taken along line 2—2

With the backing plate firmly bonded against the backside of the panel, wedge member 22 can be slid out of pin 20 having performed its function. Pin 20 can be removed from backing plate to clear recess 14*a* for the application of the patching material. In FIGS. 1 and 2, each leg 21 of pin 20 terminates at their free ends with a finger 21*a* adapted to fit into a respective elongated opening 16*a* in backing plate 16. Pin 20 can be removed from the backing plate by compressing the free ends of the pin to disengage legs 21 from its respective opening 16*a*. Recess 14*a* is cleared for insertion of the filler paste.

Figure 4:
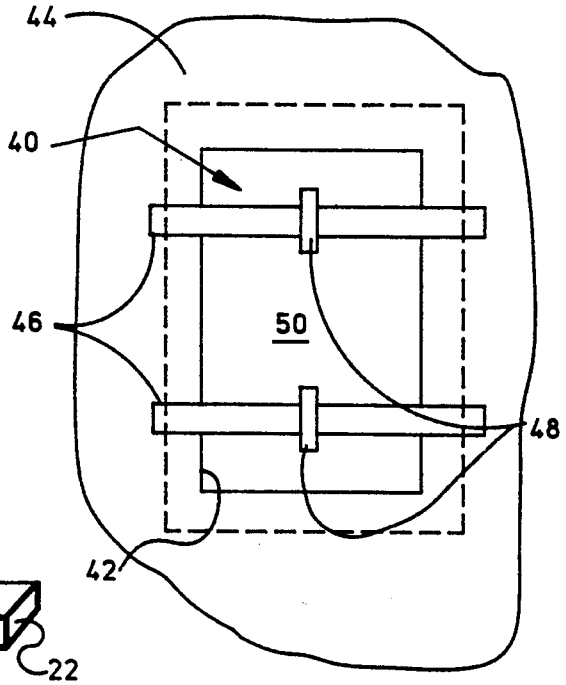
FIG. 4 is a front elevation view of a portion of a conventional hollow door or wall, similar to to FIG. 1 showing the use of pair of wedge components to secure the backing plate in position within the door or wall.

In FIG. 4, a patching kit 40 is designed to accommodate larger size holes 42 in doors and walls 44. A pair of wedge bars 46 and corresponding U-shaped pins 48 can be utilized on opposite sides of hole 42 to ensure that backing plate 50 is properly adhesively contacting the back side of wall 44 entirely around the periphery of hole 42.

In summary, a novel patching kit is provided for repairing holes in hollow doors and walls which is simple in construction and use to enable the average unskilled person to make such repairs that would otherwise require the employment of a professional carpenter or the installation of a new replacement door. The novel patching kit is made of very inexpensive components that can be discarded after use. The patching kit can include a set of different size backing plates, or any suitable sheet material can be used which can be readily cut to accommodate the configuration of the hole.

I claim:

1. A kit for patching a hole in hollow building components, such as doors and walls comprising:

a substantially stiff backing plate dimensioned to fit through the hole and adapted to be supported in position snugly flat against a backside of the front surface of the building component: said backing plate capable of blocking (a major portion) substantially the entire area of the hole to form a recessed area:

adhesive means for securing the backing plate to the backside:

means for temporarily supporting said backing plate in position including a U-shape pin having legs readily detachable from said backing plate with the loop of said pin extending through the hole to the front side of said building component:

a wedge member capable of extending through said pin and engaging the front side of said component to clamp the backing plate against the backside of the component:

whereby when the adhesive is applied around the backing plate adjacent the hole prior to insertion of the backing plate, application of the wedge means through the pin will maintain the backing plate in position until the adhesive sets at which time the wedge means and the pin can be removed from the backing plate to enable the application of a suitable patching material in the recessed area.

2. The patching kit of claim 1 wherein the ends of the pinhave lips, and the backing plate have elongated openings aligned with the pin lips to enable the legs to be detachable from said backing plate.

3. The patching kit of claim 1 wherein the wedge memberis a bar of rectangular cross-section to conform substantially to the configuration of the pin.

4. The patching kit of claim 3 wherein said wedge bar has a stepped surface.

5. The patching kit of claim 3 wherein said bar has a smooth sloping surface.

6. The patching kit of claim 3 wherein a portion of said edge bar has a stepped surface and the remaining surface has a smooth sloping surface.

* * * * *